United States Patent [19]

Pulaski

[11] 3,955,893

[45] May 11, 1976

[54] WRITING INSTRUMENT WITH PROJECTING AND RETRACTING MECHANISM

[75] Inventor: Albert Pulaski, Hollis, N.Y.

[73] Assignee: K. C. Pen Co. Inc., Brooklyn, N.Y.

[22] Filed: June 20, 1974

[21] Appl. No.: 478,721

Related U.S. Application Data

[63] Continuation of Ser. No. 259,390, June 5, 1972, Pat. No. 3,819,283.

[52] U.S. Cl. ..... 401/106

[51] Int. Cl. ..... B43k 24/02

[58] Field of Search ..... 401/104–106

[56] References Cited

UNITED STATES PATENTS

| | | | |
|---|---|---|---|
| 2,809,609 | 10/1957 | Clary et al. | 401/105 |
| 2,881,736 | 4/1959 | Zepelovitch | 401/104 |
| 2,988,055 | 6/1961 | Platt | 401/106 |
| 3,071,112 | 1/1963 | Lovejoy et al. | 401/106 |
| 3,130,710 | 4/1964 | Hansen et al. | 401/106 |
| 3,203,402 | 8/1965 | Lockwood | 401/106 |
| 3,288,114 | 11/1966 | Ritter | 401/104 |

FOREIGN PATENTS OR APPLICATIONS

| | | | |
|---|---|---|---|
| 1,284,878 | 12/1968 | Germany | 401/106 |
| 1,086,929 | 8/1954 | France | 401/106 |

*Primary Examiner*—Lawrence Charles
*Attorney, Agent, or Firm*—Howard C. Miskin

[57] ABSTRACT

A writing instrument, such as a ball-point pen, having a writing cartridge and a mechanism for projecting and retracting said writing cartridge, said mechanism being actuated by a pocket clip on the writing instrument and comprising a cam element with high and low cam faces and a cam follower which is alternately engageable with said high and low cam faces, engagement between the cam follower and the high cam face causing projection of the writing cartridge, and engagement between the cam follower and the low cam face causing retraction of the writing cartridge.

10 Claims, 10 Drawing Figures

WRITING INSTRUMENT WITH PROJECTING AND RETRACTING MECHANISM

This is a continuation of application Ser. No. 259,390 filed June 5, 1972, now U.S. Pat. No. 3,819,283 issued June 25, 1974.

BACKGROUND OF THE INVENTION

1. Field of the Invention

This invention relates to ball-point pens and other writing instruments, containing a writing cartridge which is projected to operative position and retracted to inoperative position.

2. Description of the Prior Art

The following U.S. Pat. Nos. constitute the closest prior art known to applicant:

| | | |
|---|---|---|
| 2,809,609 | Clary, et al. | October 15, 1957 |
| 2,881,736 | Zepelovitch | April 14, 1959 |
| 2,988,055 | Platt | June 13, 1961 |
| 3,071,112 | Lovejoy, et al. | January 1, 1963 |
| 3,130,710 | Hansen, et al. | April 28, 1964 |
| 3,203,402 | Lockwood | August 31, 1965 |
| 3,288,114 | Ritter | November 29, 1966 |

The closest of these patents is believed to be Zepelovitch U.S. Pat. No. 2,881,736. However, this patent does not appear to provide a projection-retraction mechanism which securely locks the writing cartridge in projected operative position. The extent of projection is inadequate. Moreover, the patent does not provide a smoothly, easily operable projection-retraction mechanism. And finally, the Zepelovitch patent does not provide a relatively inexpensive construction.

SUMMARY OF THE INVENTION

The present invention provides a projection-retraction mechanism which consists of three major component parts. The first is a double-faced cam element. The second is a cam follower which is alternately engageable with the two faces of the cam element. And the third is the pocket clip of the writing instrument, which functions as an actuator for shifting the cam follower from one cam face to the other. Different cam arrangements are possible. Two such arrangements are shown in the drawing, and it will be seen that in one case the double-faced cam is a floating element between the writing cartridge and the cam folower and in the second case the double-faced cam is attached to the casing of the writing instrument, while the cam follower is situated between the writing cartridge and said double-faced cam element. In both cases it is the cam follower which is engaged and moved by the pocket clip relative to the double-faced cam element. An alternative arrangement would be for the pocket clip to engage and move the double-faced cam element relative to the cam follower.

An important feature of the present invention resides in the fact that, whether the writing cartridge is in projected or retracted position, it is securely locked in that position against accidental or unintentional dislodgment, and only by actuation of the pocket clip would the writing cartridge be moved from either position to the other. It is known that among many prior art writing instruments of this general category the writing cartridge is relatively easily dislodged from its projected operative position, particularly when somewhat more than normal writing pressure is applied to it. It is also known that in many prior art writing instruments of this general kind the projecting and retracting mechanism occasionally slips, and it is necessary to repeatedly actuate it in order to cause it to function in the manner intended.

The projection and retraction mechanism of the present invention does not slip, and its actuation is positive in either direction, that is, from projected to retracted position, or from retracted to projected position.

An important feature of the invention resides in its relatively long retraction-projection range. As an illustration, a retraction-projection range of ⅛ inch is perfectly feasible. When extended, the writing tip of the cartridge projects 3/32 inch beyond the end of the barrel; when retracted, the writing tip is spaced 1/32 inch inwardly from the end of the barrel.

DESCRIPTION OF PREFERRED EMBODIMENTS OF THE INVENTION

Figure 1:
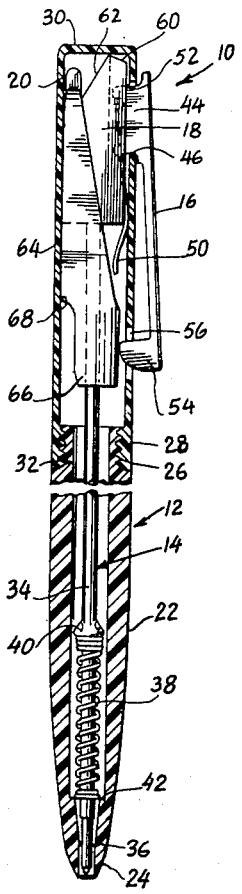
FIG. 1 is a longitudinal section through a ball-point pen embodying one form of retraction mechanism herein described and claimed, the writing element being shown in retracted position.

Referring now to the first illustrated form of the invention, it will be observed that a writing instrument 10 made in accordance with said form comprising a casing 12, a spring-biased writing cartridge 14, a pocket clip 16, a cam-faced element 18, and a cam follower 20. More particularly, casing 12 consists of a barrel 22 with a reduced lower end 24 and a threaded upper end 26 and a cap 28 having a closed upper end 30 and a threaded lower end 32 which engages the threaded upper end 26 of the barrel. Writing cartridge 14 has the usual tubular ink reservoir 34, writing element 36 connected to and communicating with said tubular ink reservoir 34, and a coiled compression spring 38 mounted between an enlargement 40 on the tubular ink reservoir and internal annular shoulder 42 in barrel 22.

Clip 16 has a bracket element 44 which extends through an opening 46 in the side of cap 28, and said bracket 44 is provided with fastening elements 48 which secure the clip to a leaf spring 50 and also to the cap 28. Leaf spring 50 engages the inner wall of the cap and applies spring tension to the clip to hold it in tensioned engagement with the outer surface of the cap. Bracket element 44 is radially slidable within opening 46 in cap 28, so that the clip can be pressed radially inwardly relative to the cap, although it is fastened to the cap. By the same token, clip 16 is also radially movable outwardly from the cap to the extent permitted by fastening elements 48. This ability of cap 16 to move radially inwardly and outwardly with respect to cap 28 is important in connection with the operation of the projecting and retracting mechanism hereinafter more fully described and discussed.

It will also be noted that pocket clip 16 is provided with an inwardly extending projection 52 at its upper end and with an inwardly extending bead 54 at its lower end. Upper projection 52 extends inwardly of cap 28. However, lower bead 54 is normally positioned exteriorly of the cap when the writing instrument is clipped to a pocket. An opening 56 is provided in cap 28, in registration with bead 54, and it will be understood that the bead will enter the cap through said opening when finger pressure is applied to the lower end of the clip.

Cam-faced element 18 is a floating cam which bears at its upper end against cam follower 20 and at its lower end against the top of the tubular ink reservoir 34. Cam-faced element 18 has a pair of cam faces 60 and 62 formed at its upper end and facing upwardly. These two cam faces are formed on opposite sides of a vertically extending plane which intersects their line of juncture. Cam face 60 is a high cam face in relation to cam face 62 (which is a low cam face in relation to cam face 60), and it will be understood that when the high cam face 60 is in engagement with cam follower 20 the writing cartridge projects outwardly in operative writing position and when the lower cam face 62 is in engagement with said cam follower 20 the writing cartridge will be in its retracted, inoperative position.

It has been found that best results, in terms of smooth operation and secure locking positions, are achieved when high cam face 60 is disposed at an angle of approximately 80° to 85°, relative to said longitudinal plane, and low cam face 62 is disposed at an angle of approximately 55° to 60°, relative to said plane.

Cam follower 20 is formed at the upper end of a lever 64, said lever having a lower end 66 and a fulcrum 68. It will be observed that lever 64 is bifurcated and generally channel-shaped in order to accomodate cam-faced element 18 and the upper end of the tubular ink reservoir 34. It will also be observed that the inwardly extending projection 52 at the upper end of the pocket clip is engageable with cam follower 20 which is situated at the upper end of lever 64, and that bead 54 of the pocket clip is engageable with the lower end 66 of said lever through opening 56 in cap 28. It will further be noted that cam-faced element 18 is provided with a channel 67 to receive leaf spring 50 and bracket 44 of the pocket clip.

Figure 2:
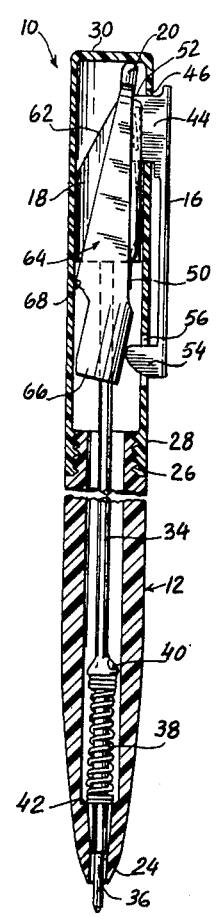
FIG. 2 is a view similar to that of FIG. 1, but showing the writing element in projected position.
Figure 3:
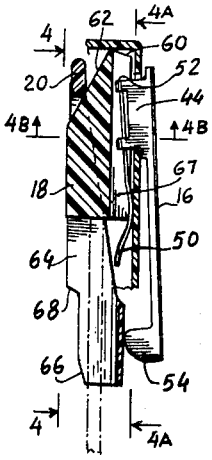
FIG. 3 is a fragmentary sectional view showing the retraction mechanism.
Figure 4:
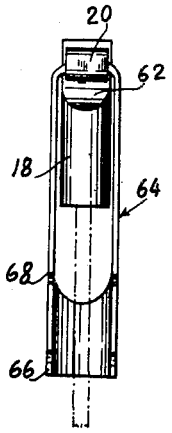
FIG. 4 is a view on the line 4—4 of FIG. 3.
Figure 4A:
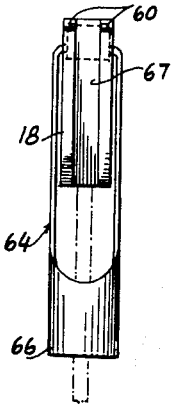
FIG. 4A is a view on the line 4A—4A of FIG. 3.
Figure 4B:
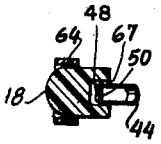
FIG. 4B is a transverse section on the line 4B—4B of FIG. 3.

The operation of the above detailed mechanism will now be described. Starting with the position of the mechanism as illustrated in FIG. 1, it will be seen that the writing cartridge is in retracted position. Cam follower 20 is in engagement with the low cam face 62 of cam element 18. In order to project the writing cartridge to operative position, the lower end of the pocket clip is pressed radially inwardly, and its bead 54 will cause lever 64 to pivot in clockwise direction about its fulcrum. This will cause cam follower 20 to ride up on cam face 62 and into engagement with cam face 60. This in turn will cause the cam element 18 to move downwardly and to push the writing cartridge outwardly into operative position against the action of spring 38. Cam follower 20 will now be locked in engagement with cam face 60. It will not be accidentally or unintentionally dislodged therefrom when pressure is applied to the writing cartridge. The result of the foregoing is shown in FIG. 2.

When it is desired to retract the writing cartridge to its FIG. 1 position, finger pressure is applied to the upper end of the pocket clip, causing projection 52 to press against cam follower 20. This will cause lever 64 to pivot in counterclockwise direction about its fulcrum 68, thereby dislodging cam follower 20 from cam face 60 and bringing said cam follower into engagement with cam face 62. Cam element 18 will now be thrust upwardly under the spring action of spring 38, and the writing cartridge will thereby move into retracted position.

Writing instrument 100, made in accordance with the second illustrated form of this invention, comprises a casing 102, a writing cartridge 104, a cam-faced element 106, a cam follower 108 integral with or supported by a lever 110, and a pocket clip 112.

Writing cartridge 104 corresponds, substantially, to writing cartridge 14, and casing 102 corresponds, with minor modifications, to casing 12. The differences between the two embodiments of the invention reside chiefly in their respective cam elements, although in principle they remain the same.

Cam-faced element 106 is the counterpart, functionally, of cam-faced element 18. Element 106 has a pair of contiguous cam faces 114 and 116 which constitute, respectively, the high and low cam faces of said cam element. Cam faces 114 and 116 have substantially the same angular relationship as cam faces 60 and 62 above described, that is, they occupy opposite sides of a longitudinal plane which passes through their line of juncture, high cam face 114 is disposed at an angle of about 80° to 85° relative to said longitudinal plane, and low cam face 116 is disposed at an angle of about 55° to 60° relative to said plane. However, where cam-faced element 18 floats between the writing cartridge and the cam follower with its cam faces directed upwardly and away from said writing cartridge, cam-faced element 106 is secured to the upper end of the casing, its cam faces directed downwardly in the direction of the writing cartridge, the cam follower element (including lever 110) floating between said cam-faced element 106 and said writing cartridge.

Lever 110 is a rockable element with a substantially circular cross-sectional shape throughout its longitudinal dimension. It has a generally conical upper end 120 which supports, or is integral with, cam follower 108, a generally cylindrical lower end 122, and an annular rim 124 formed in the general vicinity of where the lower cylindrical end 122 joins the upper conical end 120. It will hereinafter be seen that annular rim 124 functions as a fulcrum for lever 110. The cylindrical lower end of the lever is hollow to provide a receptacle 126 for the upper end of ink reservoir tube 128 of the writing cartridge. Spring 129 urges the ink reservoir tube upwardly and holds it in tensioned engagement with the lever, and the latter, in turn, is held in tensioned engagement with cam element 106.

The upper end of clip 112 is radially slidably attached to the cap component 132 of the casing by means of lugs 134 and leaf spring 136. This leaf spring, which bears against the inner wall of the cap, biases the pocket clip radially inwardly. The upper end of the pocket clip can be pushed inwardly, to a limited extent, relative to the cap, as can its lower end 138.

It will be observed that the upper end 130 of the clip is provided with a protuberance 140 which is engageable with the upper end 120 of the lever 110, and the lower end 138 of the clip is provided with a bead 142 which is engageable with the lower end 122 of the lever through hole 144 in the cap.

Figure 5:
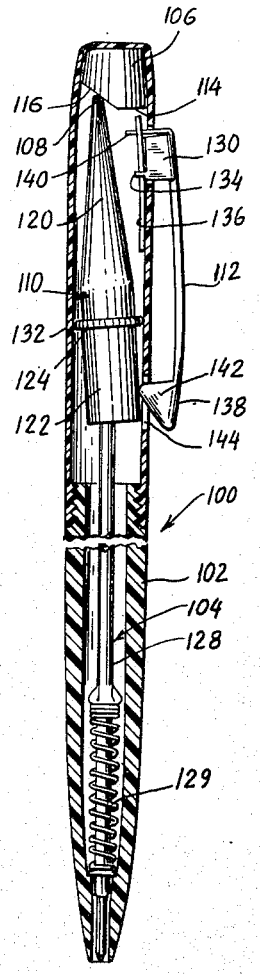
FIG. 5 is a longitudinal sectional view similar to that of FIG. 1, but showing a second form of retracting mechanism as herein described and claimed, the writing element being shown in retracted position.
Figure 6:
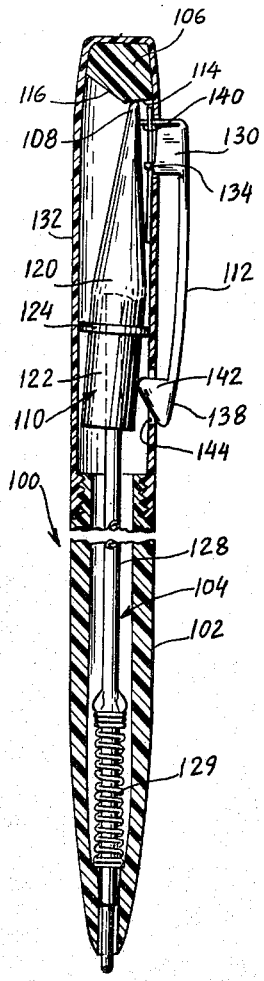
FIG. 6 is a view similar to that of FIG. 5, but showing the writing element in projected position.
Figure 7:
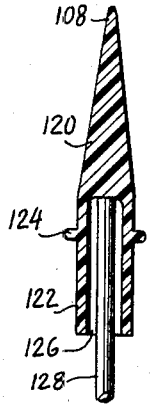
FIG. 7 is a view showing one of the retracting mechanism elements in longitudinal section.
Figure 8:
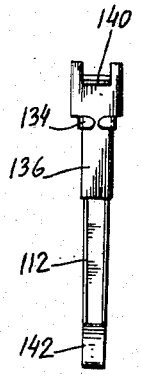
FIG. 8 is a view of the pocket clip of the ball-point pen which also serves as the means of actuating the retracting mechanism.

The action of the projecting-retracting mechanism will now be apparent. When the writing cartridge is in retracted position, as shown in FIG. 5, cam follower 108 rests against the low cam face 116 of the cam element 106. To project the writing cartridge into writing position, the lower end 138 of the pocket clip is pressed inwardly and its bead 142 will engage the lower end 122 of the lever. The lever will thereby be pivoted in clockwise direction (as viewed in FIG. 6) about the line of contact between its rim 124 and the inside wall of the cap, and its cam follower tip 108 will be shifted from low cam face 116 to high cam face 114. This will cause the lever and the writing cartridge which it engages to move downwardly and the writing cartridge will now be in projected operative position as shown in FIG. 6. To retract the writing cartridge, the upper end 130 of the pocket clip is pressed inwardly and projection 140 will engage the upper end of the lever and unseat its cam follower tip 108 from the high cam face 114 and shift it to the low cam face 116. The writing cartridge will thereby return under spring tension to its retracted position.

The foregoing is illustrative of preferred forms of the present invention, and it will be understood that variations thereof and modifications therein may be had within the broad scope of the appended claims.

I claim:

1. A writing instrument comprising a casing having a first opening at one end, a writing cartridge mounted within said casing for reciprocal longitudinal movement therein between projected writing position through said casing opening and retracted position, spring means normally biasing said cartridge into retracted position, a pair of cam elements within the casing, one a cam faced element and the other a cam follower, said cam faced element having adjacent high and low cam faces which are disposed in angular relation to each other, a lever pivotally positioned within said casing remote from said casing one end, said lever having first and second ends and a fulcrum intermediate thereof, said cam follower being positioned on the first end of the lever and being alternately engageable with said cam faces in response to pivoting of the lever, a pocket clip, said casing having second and third openings therein, said second opening registerable with said second end of said lever, means rockably mounting the clip to the casing about the third casing opening, said clip including an inwardly directed projection adjacent one end registering with said second opening in said casing and engageable with the second end of the lever, the cartridge being displaced into projected position in response to manually pressing the clip end having the projection inwardly relative to the casing for actuating the lever in one direction about its fulcrum causing the cam follower to engage the high cam surface of the cam-faced element, the cartridge being displaced into retracted position in response to manually depressing the other clip end inwardly relatively to the casing for actuating the lever in the opposite direction about its fulcrum causing the cam follower to engage the low cam face of the cam faced element.

2. A writing instrument in accordance with claim 1, wherein:

a. the cam-faced element is situated between the writing cartridge and the cam follower, b. said writing cartridge pressing under spring tension against the cam-faced element and urging it into spring-tensioned engagement with the cam follower.

3. A writing instrument in accordance with claim 2, wherein:

the cam-faced element floats between the writing cartridge and the cam follower.

4. A writing instrument in accordance with claim 1, wherein:

a. the high and low cam faces of the cam-faced element are formed on opposite sides of a plane extending longitudinally through the casing, both cam faces facing upwardly away from the writing cartridge, b. said high cam face being disposed at an angle of approximately 80° to 85° relative to said longitudinal plane, c. said low cam face being disposed at an angle of approximately 55° to 60° relative to said longitudinal plane.

5. A writing instrument in accordance with claim 1, wherein:

a. the cam follower is situated between the writing cartridge and the cam-faced element, b. said writing cartridge pressing under spring tension against the cam follower and urging it into spring-tensioned engagement with the cam-faced element.

6. A writing instrument in accordance with claim 5, wherein:

the cam-faced element is attached to the upper end of the casing.

7. A writing instrument in accordance with claim 5, wherein:

a. the high and low cam faces of the cam-faced element are formed on opposite sides of a plane extending longitudinally through the casing, both cam faces facing downwardly toward the writing cartridge, b. said high cam face being disposed at an angle of approximately 80° to 85° relative to said longitudinal plane, c. said low cam face being disposed at an angle of approximately 55° to 60° relative to said longitudinal plane.

8. A writing instrument as in claim 1 wherein said cam follower including a yoke which straddles the cam-faced element.

9. A writing instrument as in claim 1 wherein said cam follower lever lower end is generally U-shaped and its upper end being a yoke on opposite sides of said cam-faced element.

10. A writing instrument in accordance with claim 1 wherein said cam follower lever lower end is offset axially from said upper end.

* * * * *